US007735770B2

(12) United States Patent
Conner

(10) Patent No.: US 7,735,770 B2
(45) Date of Patent: Jun. 15, 2010

(54) ELECTRIC DISPENSER FOR DISPENSING SHEETS FROM A ROLL OF PERFORATED WEB MATERIAL

(75) Inventor: John Michael Conner, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 327 days.

(21) Appl. No.: 11/848,436

(22) Filed: Aug. 31, 2007

(65) Prior Publication Data

US 2009/0057478 A1 Mar. 5, 2009

(51) Int. Cl.
*B65H 16/10* (2006.01)

(52) U.S. Cl. ..... 242/564.1; 242/563.2; 242/565

(58) Field of Classification Search ..... 242/563, 242/563.1, 563.2, 564, 564.1, 564.3, 564.4, 242/565, 419, 419.5; 225/93, 106; 226/181
See application file for complete search history.

(56) References Cited

U.S. PATENT DOCUMENTS

| | | | | |
|---|---|---|---|---|
| 3,730,409 | A | 5/1973 | Ratti | |
| 5,061,232 | A * | 10/1991 | Bloch et al. | 242/564.4 |
| 5,078,033 | A * | 1/1992 | Formon | 225/14 |
| 5,205,454 | A | 4/1993 | Schutz et al. | |
| 6,412,679 | B2 | 7/2002 | Formon et al. | |
| 6,742,689 | B2 * | 6/2004 | Formon et al. | 242/564.4 |
| 6,766,977 | B2 | 7/2004 | Denen et al. | |
| 7,168,602 | B2 * | 1/2007 | Broehl | 225/106 |
| 7,191,977 | B2 * | 3/2007 | Denen et al. | 242/563.2 |
| 2002/0117578 | A1 * | 8/2002 | Denen et al. | 242/563 |
| 2003/0116003 | A1 | 6/2003 | Kapiloff | |
| 2004/0251375 | A1 * | 12/2004 | Denen et al. | 242/563 |
| 2007/0080255 | A1 * | 4/2007 | Witt et al. | 242/563.2 |

FOREIGN PATENT DOCUMENTS

| | | |
|---|---|---|
| WO | WO 00/63100 | 10/2000 |

* cited by examiner

*Primary Examiner*—William A Rivera
(74) *Attorney, Agent, or Firm*—Dority & Manning, P.A.

(57) ABSTRACT

An electronic dispenser for dispensing measured perforated sheets from a roll of perforated web material includes a housing, and a roll carrier disposed in the housing to rotationally support the roll of perforated web material. An electrically driven feed mechanism is disposed in the housing to dispense the sheets of web material therefrom. The feed mechanism includes rollers defining a drafting zone through which the web material is conveyed. The web material is drawn in the drafting zone to an extent necessary to at least partially separate the web material along a perforation line prior to the perforation line passing through the drafting zone.

16 Claims, 3 Drawing Sheets

ELECTRIC DISPENSER FOR DISPENSING SHEETS FROM A ROLL OF PERFORATED WEB MATERIAL

BACKGROUND OF THE INVENTION

The present invention relates to a dispenser for a roll of web material, and particularly to an electric dispenser that automatically dispenses individual sheets from a roll of perforated web material.

A number of dispensing devices are well known in the art for dispensing and cutting rolls of web material such as paper toweling. With certain of these dispensers, the process of dispensing and cutting the web material is carried out automatically by a user pulling on the free "tail" end of the web material that extends from a dispensing slot in the apparatus. In a typical configuration, the web material is engaged against a rough friction-enhancing surface of a feed drum and the action of pulling the web tail causes the drum to rotate. The drum includes a drive mechanism and, after the initial pull on the web tail by a user, the drum is driven a predetermined rotational degree to dispense a metered amount of the material. A cam driven cutting mechanism may be provided in the rotating drum that pivots out of a slot in the drum to automatically cut the web at the proper length. The dispensers typically include a stored energy mechanism, such as an eccentric cam, that is spring loaded during the initial rotation of the feed drum, and causes the drum to continue to rotate after the web has been cut. This action causes an additional length of the web material to be feed out of the dispensing slot as the tail for the next dispensing sequence. These types of dispensers are commonly referred to as "no-touch" or "sanitary" dispensers because the user does not manually operate any portion of the drive or cutting mechanism and does not actually have to touch the dispenser. The user only touches the tail end of the web material.

Although effective, the conventional mechanical sanitary dispensers utilizing automatic mechanical cutting and feeding mechanisms can be relatively complicated from a mechanical component standpoint and expensive to manufacture and maintain. Also, some users have noted that such dispensers present an inordinate amount of resistance to pulling a towel from the dispenser. This may be particularly true when the initial pulling action by the user must also provide the force needed to load a spring of the automatic tail feeding mechanism. Thus, web materials with relatively high tensile strength must be used with such dispensers.

Advances have been made in the art relating to electronic sanitary towel dispensers as well. With such dispensers, the unit is typically activated upon detection of motion of a user's arm or hand. A motor is subsequently energized through a control circuit and power source to drive a feed roll and thus dispense a measured length of material. The user then grabs the exposed material and pulls it at some angle to the dispenser cover causing the sheet of material to separate on a cutting edge or serrated tear bar. The cycle is repeated for the next user.

U.S. Pat. No. 3,730,409 discloses an electronic dispenser wherein initially a full measured length of towel hangs out of the dispenser. A user grabs and separates the towel by pulling it against a tear bar. A force activated switch is configured with the tear bar that activates a dispenser motor through a power source and electronic circuit upon the user tearing the towel. The motor then drives a feed roll to deliver a full measured length of towel material outside of the dispenser cabinet where it hangs for the next user to grab and tear. WO 00/63100 describes an electronic dispenser with a similar operating principle. These dispensers have the disadvantage that the entire towel sheet hangs out of the dispenser prior to use. This is obviously not a sanitary or desirable condition.

Advances in paper making technology allow for relatively easy formation of perforations in sheet material, and a number of dispensers are known for dispensing rolled sheet material having spaced rows of preformed perforations. Such perforations weaken the sheet material, making it easier to separate an individual sheet from the remainder of sheet material. For example, U.S. Pat. No. 6,412,679 describes a motorized dispenser for dispensing sheets from a roll having spaced perforation lines. A sensor detects removal of a dispensed sheet before permitting a subsequent dispensing cycle, and also senses the leading edge of the sheet and meters the amount dispensed in order to maintain registration with the perforations. The user must grasp the dispensed sheet and tear the material along the perforation line.

U.S. Pat. No. 5,205,454 describes a dispenser wherein the sheet material is separated into individual segments by perforated tear lines which are shaped to incrementally pass through a nip formed by nip rollers due to a pulling force exerted on an end-most segment by a user. A drag force opposed to the pulling force is exerted on the sheet material by the nip rollers so that the tear line tears as it passes through the nip. Tearing along the perforated tear line is not completed until a portion of an adjacent segment is presented for pulling by a subsequent user.

U.S. Pat. No. 6,766977 describes a dispenser for dispensing individual sheets from a dispenser containing a source of sheet material having a plurality of spaced perforations. The dispenser includes at least one rotatable roller, a rotation monitor configured to monitor the amount of rotation of the roller to thereby determine the amount of sheet material traveling downstream from the roller, a perforation sensor for sensing perforations in the sheet material, and an outlet for dispensing sheet material. The amount of rotation of the roller is detected and the advancing of the sheet material is stopped when the roller rotates a first predetermined amount and a perforation is detected. The user must grasp the dispensed sheet and tear the material along the perforation line.

The perforated sheet material dispensers, such as those described above, have the disadvantage that the sheets are ultimately separated by the user grasping and pulling on the exposed sheet with sufficient force to separate the material along the perforation line. This necessitates structure and relatively complicated control circuitry to ensure that the perforation line is aligned or registered at a precise location with the housing, and for breaking rotation of the feed roller so that the necessary force is generated for tearing the material. Stretching or slipping of the web material, or tearing of the web material at a location other than at a perforation line, may prevent further operation of the dispenser.

The present invention relates to an improved electric dispenser for perforated sheet material that eliminates that addresses at least some of the drawbacks of conventional mechanical and electrical perforated sheet material dispensers.

SUMMARY

Objects and advantages of the invention will be set forth in part in the following description, or may be obvious from the description, or may be learned through practice of the invention.

The present invention provides an electronic dispenser for dispensing individual sheets from a roll of web material having spaced perforations formed therein. The dispenser is not limited to dispensing any particular type of rolled web material, but is particularly useful for dispensing measured sheets of towel material and will be referred to and illustrated herein as a towel dispenser for ease of explanation. The dispenser is a "sanitary" or "no-touch" dispenser in that the user only touches the tail of the material extending out of the dispenser to dispense a measured sheet and need not activate or manually manipulate a dispensing mechanism or any portion of the dispenser during normal use.

The dispenser includes a housing of any shape, configuration, or aesthetic appearance. A roll carrier is disposed in the housing for rotationally carrying a roll of the perforated web material. A dispensing slot is defined in the housing through which a "tail" sheet extends for grasping and pulling by the user. This sheet has already been at least partially separated along an upstream perforation line, and may be completely separated along the perforation line, such that minimal force is exerted by the user to remove the sheet from the dispenser.

An electrically driven feed mechanism is disposed in the housing, and an electric motor is configured for driving the feed mechanism. A power source, such as a battery or external power circuit, is provided to power the motor and associated circuitry.

In a particular embodiment, the feed mechanism includes rollers defining a drafting zone through which the web material is conveyed. Within this drafting zone, the web material is drafted or drawn to an extent necessary to at least partially separate the web material along a perforation line prior to the perforation line passing through the drafting zone. The degree of draft or drawing force exerted on the web material may be established as a function of the perforation profile in the sheet material. For example, a perforation profile with a greater percentage of total slit length (as compared to total length of unperforated web material) defines a "weaker" profile that requires less drafting to separate the material along the perforation line.

It should be understood that the web material is "at least partially separated" along the perforation line such that a minimal amount, if any, of the web material remains intact along the perforation line. Any amount less than about 50%, or less than about 25%, or less than about 10%, of the original web material integrity along the perforation line may be considered as "at least partially separated."

Upon activation of the dispenser, a user is presented with a tail of a sheet of the web material extending from the dispensing slot, with the upstream end of the sheet being completely or at least partially separated along the perforation line so that minimal force is exerted by the user to pull the sheet from said dispenser. This pulling action may simply remove the completely separate sheet from between the downstream drafting rollers, or may also serve to completely separate any remaining intact portion of the web material along the perforation line.

The electric motor may be geared to any combination of the drafting rollers to define the desired degree of draft as a function of different rotational or conveying speeds of different sets of drafting rollers. In a particular embodiment, the drafting zone rollers define an upstream nip point and a downstream nip point, with the conveying speed of the downstream nip point being greater than the upstream nip point to provide the desired degree of draft within the drafting zone. Each of the nip points includes a pair of rollers, with one of the rollers being a driven roller. The feed mechanism may include a single electric motor to provide the motive force for the drive rollers, or separate motors may be utilized.

The dispenser may include a perforation separation sensor disposed along the running path of the web material through the drafting zone, for example adjacent to the downstream nip point. This sensor may be any suitable device that is configured to detect separation of the sheet material along the perforation line as a result of drafting within the drafting zone. For example, the sensor may include a light emitter disposed on one side of the running web material, and a light collector disposed on the opposite side of the material, with the sensor being calibrated to register a "detect" when sufficient light passes through the separated material along the perforation line. It should be appreciated that the perforation separation sensor includes any contact or non-contacting device configured to recognize or detect separation of the sheet material. A number of suitable devices are well known to those skilled in the art any may be utilized in this regard.

Upon detection of separation of the sheet material along the perforation line, the sensor generates a signal to stop the feed mechanism just after the perforation line has passed through the drafting zone. Desirably, the drive rollers are stopped just as the perforation line passes between the downstream nip rollers. This ensures that the following sheet is threaded between the downstream nip rollers for a subsequent dispense sequence. Also, in the event that the sheet material is essentially completely separated along the perforation line, the nip rollers act as a clamp to hold the separated sheet until the tail is pulled by the user.

The dispenser may be configured as an automatic dispenser that uses any manner of known sensing device to detect the presence of a user and to automatically activate the dispenser to dispense a sheet of the web material. Such automatic sensing and detection systems are well known to those skilled in the art, and include IR, RF, capacitive, and other devices. Any one or combinations of such systems are suitable for the present dispenser.

In a particular embodiment of the feed mechanism, the drafting zone rollers define an upstream nip point and a downstream nip point, with each of the nip points comprising a driven roll and an idler roll. A single roll may be utilized to define the driven roll of the upstream nip point and the idler roll of the downstream nip point. For example, this single roll may include a first surface that contacts the web material only at the upstream nip point, and a second surface that contacts the web material only at the downstream nip point. The single roller may be driven by a single motor, with the first surface rotationally fixed relative to the axis of the single roller and defining the driven roller at the upstream nip point, and the second surface defining the idler roller at the downstream nip point. The first and second surfaces of the single roller may be defined by interspaced roller segments that engage against corresponding roller segments at the upstream and downstream nip points.

A control circuit may be provided to coordinate operation of the various components. For example, a circuit may be in communication with the power supply, motor, and different sensors. Activation of the detection sensor may cause a contact in the control circuitry to close wherein power is then supplied to the motor to dispense a length of the web material. The perforation separation sensor relays a single to the control circuitry to stop the motor and feed mechanism at the appropriate time. Design of any suitable control circuit is well within the level of skill of those in the art.

The invention will be described in greater detail below by reference to embodiments thereof illustrated in the figures.

DETAILED DESCRIPTION

Figure 1:
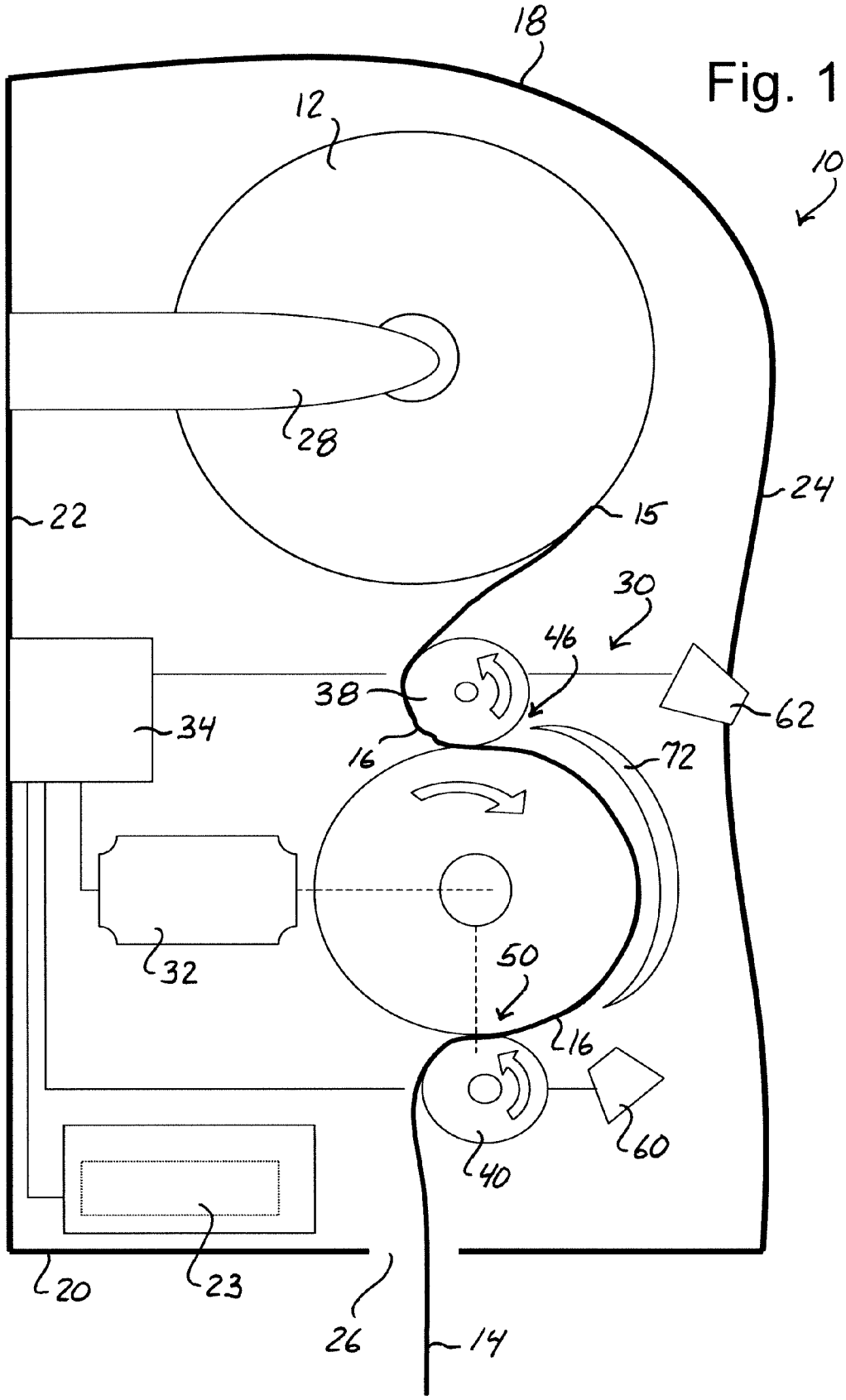
FIG. 1 is cross-sectional diagrammatic view of an embodiment of a dispenser according to the invention.

Reference will now be made in detail to embodiments of the present invention, examples of which are illustrated in the Figs. Each embodiment is provided by way of explanation of the invention, at not meant as a limitation of the invention. For example, features illustrated or described as part of one embodiment may be used with another embodiment to yield still a further embodiment. It is intended that the present invention include these and other modifications and variations coming within the scope and spirit of the invention.

Embodiments of a dispenser 10 incorporating basic operational features according to the present invention are illustrated in the figures. The dispenser 10 is configured to dispense a primary roll 12 of web material 16 that may be, for example, a standard eight-inch towel roll. For illustrative purposes only, the roll 12 will be referred to as a towel roll and the web material will be referred to as towel material. The web material 16 includes a plurality of spaced perforation lines that define individual sheets of the material. The manufacture and use of perforated rolls of towel material is well known in the art.

The dispenser 10 includes a housing 18 of any general shape and configuration. The housing 18 includes a bottom portion 20, a front portion 24, and a back portion 22. The dispenser 10 may be mounted to a vertical supporting wall structure by any conventional means. A dispensing slot 26 is defined at an appropriate location in the housing 18. In the illustrated embodiment, the dispensing slot 26 is provided in the bottom portion 20. It should be understood that the dispensing slot 26 may be disposed at various locations in the housing depending on the conveying path of the towel material 16 and configuration of the internal components of the dispenser 10. The dispensing slot 26 is disposed so that a user can see a tail 14 of the towel material extending therefrom and has easy access to grasp and pull the tail 14.

It should be appreciated that the dispenser 10 according to the invention is not limited in its construction by any particular type of materials. For example, the back portion 22 and/or bottom portion 20 may be formed as a sheet metal assembly and the front portion 24 may comprise a removable or pivotal plastic assembly.

The roll 12 is rotatably disposed in the housing 18 by any manner of suitable carrier, such as the side arms 28 disclosed in FIG. 1. Various configurations of carrier mechanisms are know in the art for rotatably supporting a roll of material in a dispenser, and any such device may be used with the present invention.

The dispenser 10 incorporates an electrical feed mechanism, generally 30. The towel material 16 passes through the feed mechanism 30 in its running path through the dispenser housing 18. As will be described in greater detail herein, the feed mechanism 30 is activated to dispense a measured length of the towel material 16 from the dispensing slot 26 upon detection of a user. The dispense sequence provides a tail that extends from the slot 26 for the user to remove from the dispenser with minimal effort. It is not necessary that the tail 14 be pulled against a tear bar or other cutting device to be separated from the roll material 16, as explained in greater detail below.

In the illustrated embodiment of the dispenser 10, the feed mechanism 30 includes a driven feed roller 36 rotatably mounted in the housing 18 by any conventional mounting mechanism. The feed roller 36 is drivingly engaged by an electrically powered motor 32. The feed roller 36 may be engaged by the motor by any one of a number of conventional devices. For example, the feed roller 36 may be directly geared to the output shaft of the motor 32, as illustrated in the figures. In an alternate embodiment, a clutch mechanism may be operably disposed between the motor 32 and the feed roller 36. In still another embodiment, the motor 32 may drive a friction roll that is engaged against and thus rotates the feed roller 36. It should be appreciated that any means of transferring power from the drive motor 32 to the feed roller 36 is within the scope and spirit of the invention.

In the illustrated embodiment, an idler roller 38 is disposed in opposition to the feed roller 36 and defines an upstream nip point 46 with the feed roller 36 through which the towel material 16 passes, as illustrated in the figures. Any number and configuration of deflection rollers or other structure may be used to direct the path of the towel material 16 within the housing 18 to the upstream nip point 46. The idler roller 38 may be biased against the feed roller 36 to ensure that the towel material is frictionally engaged against the surface (or multiple surfaces) of the feed roller 36 so that rotation of the feed roller 36 causes the towel material 16 to be dispensed from the dispenser 10.

Various combinations or rollers or roll segments are utilized in the feed mechanism 30 to define a drafting zone 44 through which the web material 16 is conveyed. The drafting zone 44 may be defined between the upstream nip point 46 and a downstream nip point 50, with the downstream nip point 50 having a greater conveying speed than the upstream nip point 46. Within this drafting zone, the web material 16 is drafted or drawn to an extent necessary to at least partially separate the web material 16 along a perforation line 15 prior to the perforation line passing through the drafting zone 44. The degree of draft or drawing force (i.e., rotational or conveying speed difference between the nip points) exerted on the web material 16 may be established as a function of the perforation profile in the sheet material. For example, a perforation profile 15 with a greater percentage of total slit length (as compared to total length of intact or un-slit web material) defines a "weaker" profile that requires less drafting to separate the material 16 along the perforation line.

Figure 2:
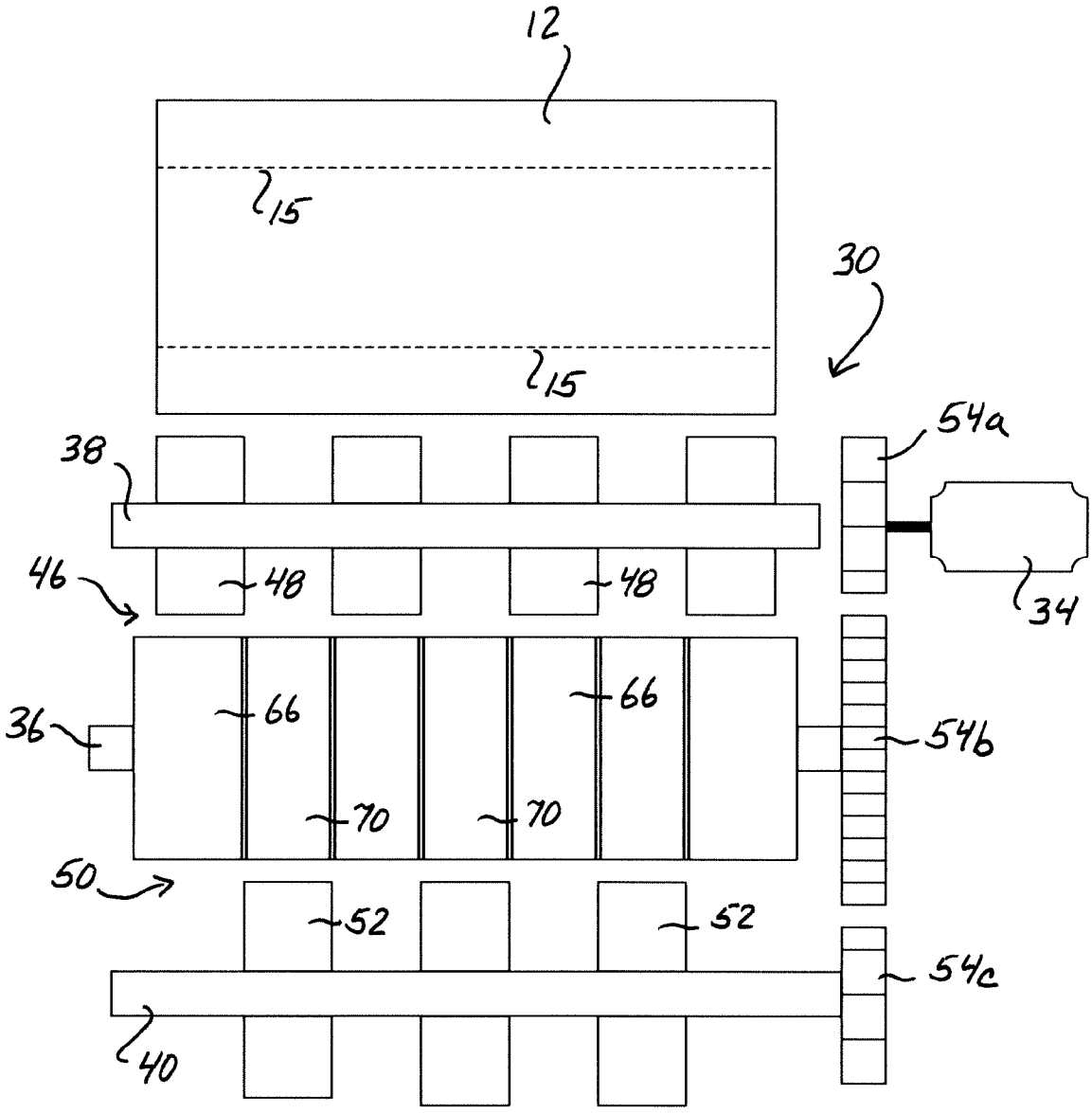
FIG. 2 is a front diagrammatic view of internal components of a dispenser according to the invention.

In the illustrated embodiment, the upstream and downstream drafting points 46, 50 are each defined by driven roll or roll segments, and an idler roll or roll segments. For example, referring to FIGS. 1 and 2, the upstream nip point 46 is defined by the spaced roll segments 48 provided on the idler roller 38, and the driven roller segments 66 provided on the drive roller 36. The driven roller segments 66 are rotationally fixed to drive roller 36 and are thus driven by the motor 34 through gears 54*a* and 54*b*. The downstream nip point 50 is defined by the driven roller segments 52 provided on the second driven roller 40. The roller segments 52 are rotationally fixed relative to the driven roller 40, which is driven by motor 34 through gears 54*b* and 54*c*. The roller segments 52 engage against idler roller segments 70 provided on the drive roller 36 spaced between the driven roller segments 66. The idler roller segments 66 are free to rotate relative to the roller 36. With this unique configuration, a single roll driven by a single motor may be utilized to define the driven roll of the upstream nip point and the idler roll of the downstream nip point. For example, this single roll 366 may include a first surface, such as roller segments 66, that contacts the web material 16 only at the upstream nip point 46, and a second surface, such as roller segments 70, that contacts the web material 16 only at the downstream nip point 50.

As discussed above, the web material 16 is at least partially separated along the perforation line 15 such that a minimal amount, if any, of the web material remains intact along the perforation line. Any amount less than about 50%, or less than about 25%, or less than about 10%, of the original web material integrity along the perforation line may be considered as "at least partially separated." Upon activation of the dispenser 10, a user is presented with the tail 14 of the sheet material extending from the dispensing slot 26, with the upstream end of the sheet being completely or at least partially separated along the perforation line 15 so that minimal force is exerted by the user to pull the sheet from said dispenser 10.

Referring to FIG. 1, in the event that the web material 16 completely separates along the perforation line 15 prior to passing through the downstream nip point 50, any manner of web guide structure, such as the guide plate 72, may be provided to ensure that the free end of the web material is directed to the nip point 50 and does not result in a jam condition. The guide plate 72 is shaped and disposed so as to thread a free end of the web material 16 into the nip point 50.

Figure 3A:
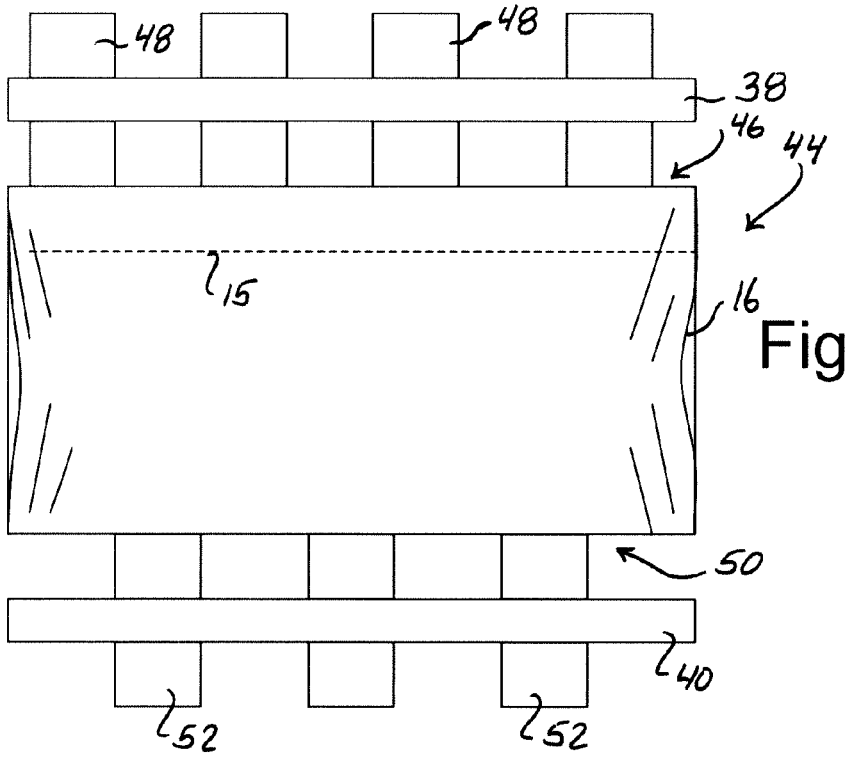
FIGS. 3A and 3B are diagrammatic operational views illustrating the drafting zone feature of a dispenser according to the invention.
Figure 3B:
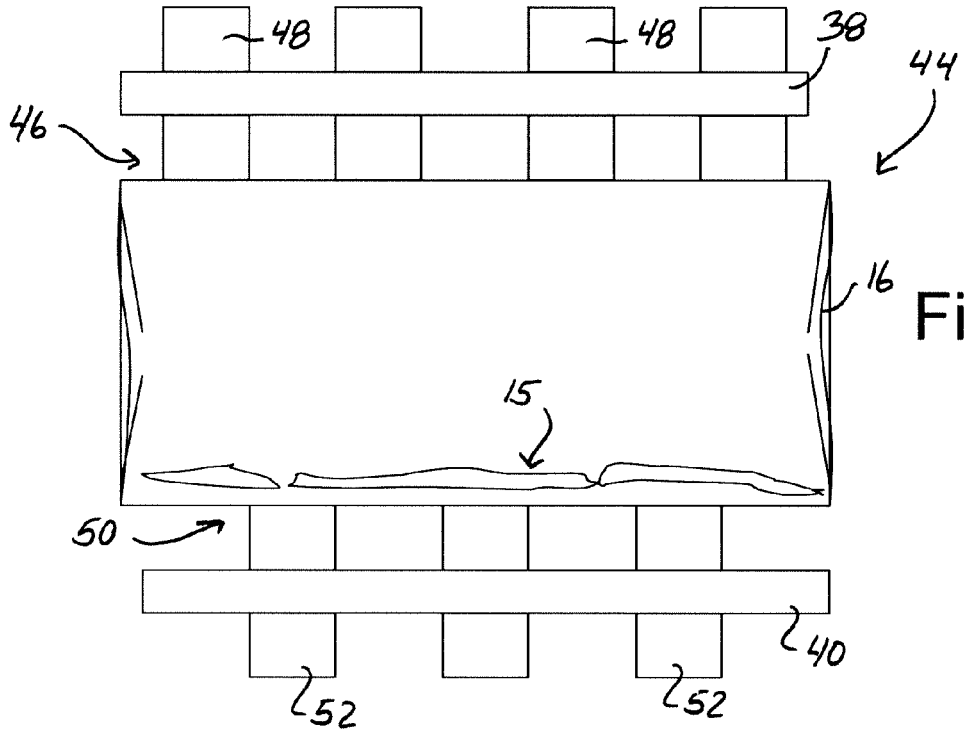

FIGS. 3A and 3B conceptually illustrate separation of the web material 16 along the perforation line 15. In FIG. 3A, the perforation line 15 has just passed through the upstream nip point 46 and has entered into the drafting zone 44 wherein the conveying speed difference between the upstream and downstream nip points exerts a pulling or drawing tension on the web material causing the sheet material to separate along the weakened perforation line 15. The degree of draft is established such that the material does not separate completely within the drafting zone 44, but passes into or through the downstream nip point 50 with at least some sheet integrity alone the perforation line 15, as illustrated in FIG. 3B. The material 16 may actually completely separate within the nip point 50 and be held or "clamped" between the roller surfaces at the nip point 50.

As a result of the complete or nearly complete separation of the sheet material 16 along the perforation line 15, the tail 14 presented to the user is readily removed by the user simply tugging or pulling on the tail with minimal effort.

The electric motor 32 may be geared to any combination of the drafting rollers to define the desired degree of draft as a function of different rotational or conveying speeds between the nip points 46 and 50. In the illustrated embodiments, gear 54*a* at the output off the motor 32 is engaged with gear 54*b* connected to roller 36. Gear 54*c* on roller 40 is engaged with gear 54*b* and is thus also driven by the motor 34. As mentioned, roller 38 may be an idler roller that is biased against roller 36. The gear ratios between the different sets off engaged gears defines the draft in the drafting zone 44.

The dispenser 10 may include a perforation separation sensor disposed along the running path of the web material 16 through the drafting zone 44, for example adjacent to the downstream nip point 50, as illustrated conceptually in FIG. 1. This 60 sensor may be any suitable device that is configured to detect separation of the sheet material 16 along the perforation line 15 as a result of drafting within the drafting zone 44. For example, the sensor 60 may the combination of a light emitter disposed on ones side of the running web material 16, and a light collector disposed on the opposite side of the material 16, with the sensor 60 being calibrated to register a "detect" when sufficient light passes through the separated material along the perforation line 15. U.S. Pat. No. 6,766,977 describes a light emitter/collector perforation sensor that they may utilized with embodiments of the present dispenser. It should be appreciated that the perforation separation sensor 60 may include any contact or non-contacting sensor device configured to recognize or detect separation of the sheet material 16 along the perforation line 15. A number of suitable devices are well known to those skilled in the art any may be utilized in this regard.

Upon detection of sufficient separation of the sheet material 16 along the perforation line 15, the sensor 60 generates a signal to stop the feed mechanism 30 just after the perforation line 15 has passed through the drafting zone 44. Desirably, the drive rollers are stopped just as the separated perforation line 15 passes between the downstream nip rollers. This control function ensures that the following sheet is threaded between the downstream nip rollers for a subsequent dispense sequence. Also, in the event that the sheet material 16 is essentially completely separated along the perforation line, the nip rollers act as a clamp to hold the separated sheet until the tail 14 is pulled by the user. In this instance, the roller 36 may be provided with a one-way clutch mechanism to allow at least some degree of rotation of the drive roller segments 52 upon the user grasping and pulling the tail 14 to easily remove the sheet material 16 from between the roller segments 52 and 70.

The dispenser 10 may be configured as an automatic dispenser that uses any manner of known sensing device 62 to detect the presence of a user and to automatically activate the dispenser to dispense a sheet of the web material. Such automatic sensing and detection systems are well known to those skilled in the art, and include IR, RF, capacitive, and other devices. Any one or combinations of such systems are suitable for the present dispenser.

A control circuit 34 may be provided to coordinate operation of the various components. For example, the circuit 34 may be in communication with a power supply, such as an internal battery 33, motor 34, and different sensors 60, 62. Activation of the detection sensor 62 may cause a contact in the control circuitry 34 to close wherein power is then supplied to the motor 32 to dispense a length of the web material. The perforation separation 60 sensor relays a signal to the control circuitry 34 to stop the motor 32 and feed mechanism 30 at the correct time, as discussed above. Design of any suitable control circuit 34 is well within the level of skill of those in the art. It should be appreciated that the term "control circuit" is used herein to broadly define any combination of relays, switches, power sources, counters, sensors, integrated circuit boards, and the like that route the various signals and actuate the various components of the dispenser 10 in the desired sequence.

As mentioned, a power supply may be contained within the housing 18 to power the various electronic components and control circuit 34. The power source may include a battery compartment 33 for disposable DC batteries. Although not shown in the figures, an AC to DC adapter may be utilized to provide an alternate source of power to the dispenser 10. This embodiment may be particularly useful wherein the dispenser 10 is mounted in close proximity to an AC outlet.

An emergency feed button (not shown) may also be provided with the dispenser 10 as a way for a technician or maintenance person to bypass the circuitry and energize the motor 32 for driving a length of the towel material from the dispenser. This may be necessary, for example, when the tail 14 has become jammed within the dispenser and does not extend out of the dispensing slot 26.

The dispenser 10 may also incorporate a device to indicate to a user or technician that power is available to the dispenser. This device may be a relatively simple light or LED display that is illuminated so long as power is available. Any number or suitable indicators may be used in this regard.

It should also be appreciated that a dispenser 10 according to the invention may incorporate any combination of additional features found on conventional hands-free dispensers. For example, the dispenser may include an emergency manual feed device such as a manual hand wheel or knob. The dispenser may be configured to dispense a stub roll in addition to a primary roll. Any combination of such additional features is within the scope and spirit of the invention.

It should be appreciated by those skilled in the art that various modifications and variations can be made to the embodiments of the invention illustrated and described herein without departing from the scope and spirit of the invention.

What is claimed is:

1. An electronic dispenser for dispensing measured perforated sheets from a roll of perforated web material, comprising:

a housing, and a roll carrier disposed in said housing to rotationally support the roll of perforated web material, said housing further comprising a dispensing slot defined therein through which the sheets of the web material are dispensed;

an electrically driven feed mechanism disposed in said housing to dispense the sheets of web material therefrom;

said feed mechanism comprising rollers defining a drafting zone between upstream an downstream nip points having different respective conveying speeds through which the web material is conveyed, the web material being tensioned in said drafting zone to an extent necessary to at least partially separate the web material along a perforation line prior to the perforation line passing through said drafting zone; and wherein upon activation of said dispenser, a user is presented with a tail a measured sheet of the web material extending from said dispensing slot, the upstream end of the sheet being at least partially separated along the perforation line so that minimal force is exerted by the user to pull the sheet from said dispenser.

2. The dispenser as in claim 1, further comprising an electric motor configured with said drafting zone rollers, said motor geared with said rollers so as to define the desired degree of draft within said drafting zone.

3. The dispenser as in claim 1, wherein the conveying speed of said downstream nip point is greater than said upstream nip point to define the desired degree of draft within said drafting zone.

4. The dispenser as in claim 3, further comprising a single electric motor geared to a drive roller at each of said nip points.

5. The dispenser as in claim 1, further comprising a perforation break sensor disposed along a running path of the web material through said drafting zone, said perforation break sensor detecting separation of the sheet material along a perforation line and generating a signal to stop said feed mechanism just after the perforation line has passed through said drafting zone.

6. The dispenser as in claim 5, further comprising a sensor disposed to detect the presence of a user and to automatically activate said dispenser to dispense a sheet of the web material.

7. The dispenser as in claim 6, further comprising a control circuit configured with said feed mechanism, said perforation break sensor, and said activation sensor.

8. The dispenser as in claim 1, wherein the conveying speed of said downstream nip point is greater than said upstream nip point to define the desired degree of draft within said drafting zone, each of said nip points comprising a driven roll and an idler roll, and wherein a single roll defines said driven roll of said upstream nip point and said idler roll of said downstream nip point.

9. The dispenser as in claim 8, wherein said single roll comprises a first surface that contacts said web material only at said upstream nip point, and a second surface that contacts said web material only at said downstream nip point.

10. The dispenser as in claim 9, wherein said single roller is driven by a motor, said first surface rotationally fixed relative to said single roller and defining said driven roller at said upstream nip point, and said second surface defining said idler roller at said downstream nip point.

11. The dispenser as in claim 10, wherein said first and second surfaces of said single roller comprise interspaced roller segments that engage against corresponding roller segments at said upstream and downstream nip points.

12. An automatic electronic dispenser for dispensing measured perforated sheets from a roll of perforated web material, comprising:

a housing, and a roll carrier disposed in said housing to rotationally support a roll of perforated web material, said housing further comprising a dispensing slot defined therein through which the sheets of the web material are dispensed;

a sensor disposed to detect the presence of a user and to automatically initiate a dispense sequence to dispense a sheet of the web material;

an electrically driven teed mechanism disposed in said housing to dispense the sheets of web material therefrom;

said feed mechanism comprising rollers defining a drafting zone through which the web material is conveyed, said drafting zone rollers defining an upstream nip point and a downstream nip point, each of said nip points comprising a driven roll and an idler roll, the conveying speed at said downstream nip point being greater than said upstream nip point to define a desired degree of draft within said drafting zone such that the web material is at least partially separated along a perforation line prior to the perforation line passing through said drafting zone; and wherein upon activation of said dispenser, a user is presented with a tail of a measured sheet of the web material extending from said dispensing slot, the upstream end of the sheet being at least partially separated along the perforation line so that minimal force is exerted by the user to pull the sheet from said dispenser.

13. The dispenser as in claim 12, wherein a single roll defines said driven roll of said upstream nip point and said idler roll of said downstream nip point.

14. The dispenser as in claim 13, wherein said single roll comprises a first surface that contacts said web material only at said upstream nip point, and a second surface that contacts said web material only at said downstream nip point.

15. The dispenser as in claim 14, wherein said single roller is driven by a motor, said first surface rotationally fixed relative to said single roller and defining said driven roller at said upstream nip point, and said second surface defining said idler roller at said downstream nip point.

16. The dispenser as in claim 15, wherein said first and second surfaces of said single roller comprise interspaced roller segments that engage against corresponding roller segments at said upstream and downstream nip points.

* * * * *